US007100234B2

(12) United States Patent
Weber et al.

(10) Patent No.: US 7,100,234 B2
(45) Date of Patent: Sep. 5, 2006

(54) SUCTION NOZZLE CONFIGURATION

(75) Inventors: Vincent L. Weber, North Lawrence, OH (US); Greg A. Bilek, Doylestown, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 10/863,674

(22) Filed: Jun. 8, 2004

(65) Prior Publication Data

US 2004/0221421 A1 Nov. 11, 2004

Related U.S. Application Data

(62) Division of application No. 10/044,774, filed on Jan. 11, 2002, now Pat. No. 6,772,475.

(60) Provisional application No. 60/266,713, filed on Feb. 6, 2001.

(51) Int. Cl.
*A47L 9/04* (2006.01)

(52) U.S. Cl. ..... 15/41.1; 15/52.1; 15/384; 15/389; 15/366

(58) Field of Classification Search ..... 15/41.1, 15/52.1, 503, 5, 383, 384, 389, 366, 50.3
See application file for complete search history.

(56) References Cited

U.S. PATENT DOCUMENTS 779,773 A * 1/1905 Dunaway et al. ..... 15/384
1,607,500 A * 11/1926 Agar et al. ..... 15/52.1
1,900,889 A * 3/1933 Becker ..... 15/384
2,396,861 A * 3/1946 Linderoth ..... 15/41.1
2,536,902 A * 1/1951 Beckett ..... 15/345
2,651,803 A * 9/1953 Browne ..... 15/366
3,583,818 A * 6/1971 Smyth et al. ..... 15/41.1
4,426,751 A * 1/1984 Nordeen ..... 15/384
4,850,077 A * 7/1989 Venturini ..... 15/384
6,550,099 B1 * 4/2003 Worwag ..... 15/389

* cited by examiner

*Primary Examiner*—Theresa T. Snider
(74) *Attorney, Agent, or Firm*—A. Burgess Lowe; Michael J. Corrigan

(57) ABSTRACT

A suction nozzle for a floor care appliance such as an upright vacuum cleaner having at least a first channel located above an agitator to carry air and dirt to a suction passageway. The cleaner has several embodiments, one of which has a single channel and a single agitator. Another embodiment has front and rear suction ducts, a channel, and a single agitator. Yet another embodiment has the single channel and dual agitators. Still yet another embodiment has front and rear suction ducts and dual agitators. Further yet still, another embodiment has front and rear suction ducts, a channel, and dual agitators. Several embodiments of an agitator drive assembly are provided using various means to provide rotary power to the agitator(s).

6 Claims, 10 Drawing Sheets

SUCTION NOZZLE CONFIGURATION

RELATED APPLICATION

This application is a division of 10/044,774, filed Jan. 11, 2002, now U.S. Pat. No. 6,772,475, and claims priority to provisional application Ser. No. 60/266,713 filed on Feb. 6, 2001.

BACKGROUND OF THE INVENTION

1. Field of the Invention

This invention relates to a suction nozzle for floor care appliances having single or multiple agitators and the appliances having single or multiple channels for air flow entrained with dirt.

2. Description of Related Prior Art

Cleaners have been provided using single ducts or two ducts for carrying away dirt. However, none of these ducts were centrally located in the nozzle and located above the agitator. Further, cleaners utilizing dual agitators are known but are generally not common in the art. What is needed in the art are floor care appliances having multiple channels for carrying away dirt with the option of providing at least two agitators.

SUMMARY OF THE INVENTION

The present invention provides multiple embodiments of floor care appliances such as an upright vacuum cleaner having various configurations of a suction nozzle. The various embodiments may have a channel located above one or more rotary agitator to improve the performance of the nozzle in removing dirt particles from the floor surface and transporting the dirt particles to a suction passageway for further collection. The embodiments of the suction nozzle may also contain front and/or rear suction ducts to further improve the performance of the nozzle in removing dirt particles from the floor surface and for transporting dirt particles to the suction passageway.

BRIEF DESCRIPTION OF DRAWINGS

A preferred embodiment of the present invention will now be described, by way of example, with reference to the accompanying drawings, of which.

DETAILED DESCRIPTION OF THE INVENTION

Figure 1:
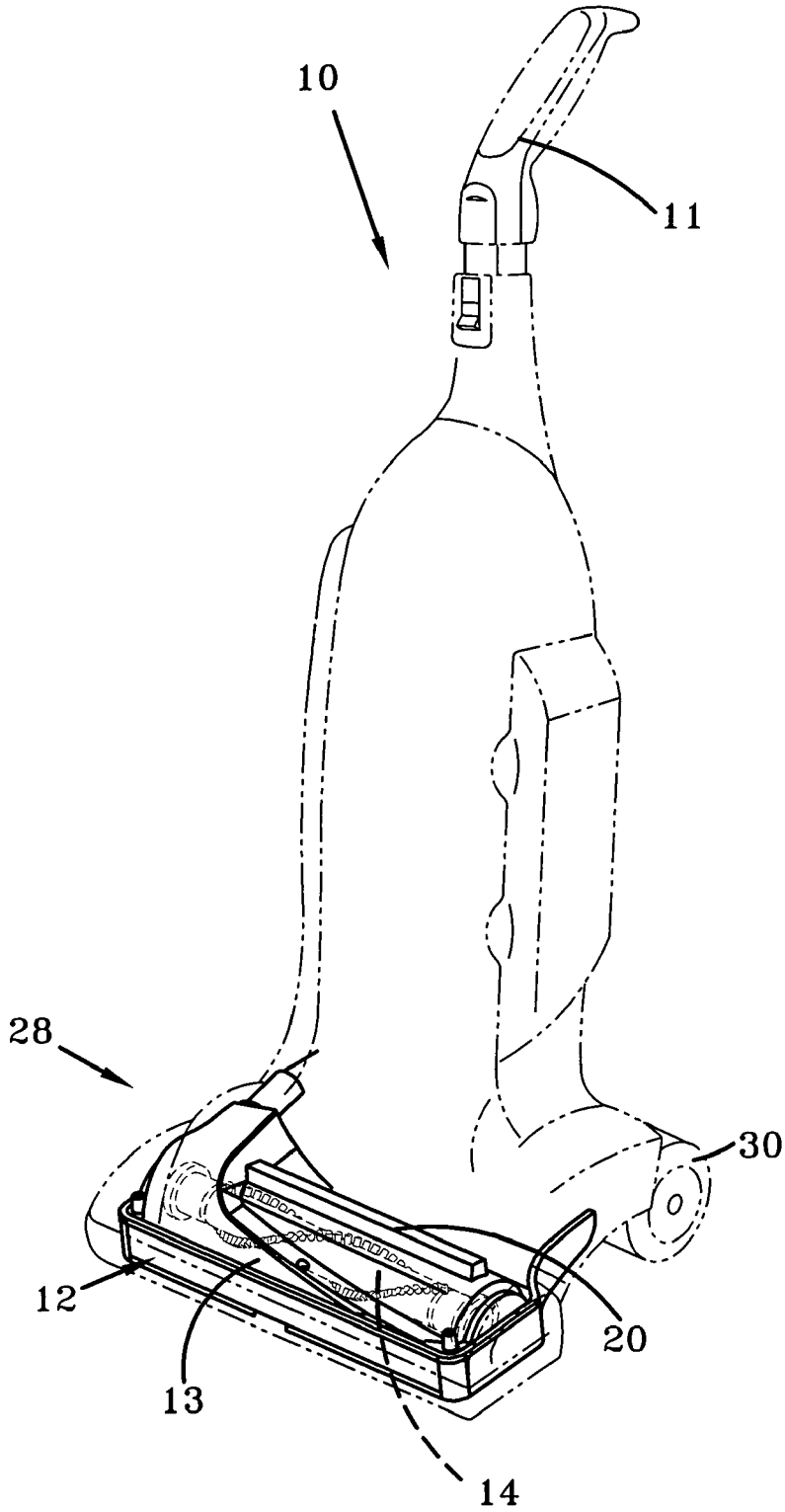
FIG. 1 is a perspective view of a suction nozzle arrangement, according to the preferred embodiment of the present invention.

Referring now to FIGS. 1–5 and 7, shown in a suction nozzle 28 of a vacuum cleaner having a handle 11, according to the preferred embodiments of the invention. Specifically, FIG. 1 shows a suction nozzle 28 comprised of an agitator housing 12, an agitator chamber 13, and agitator 14, a first channel 20 located on top of the agitator chamber 13, and a pair of integral front and rear sidewardly extending suction ducts 40, 42. The nozzle 28 is generally part of a floor care appliance such as that shown in the dashed lines in FIG. 1. The nozzle 28 itself comprises the agitator housing 12, preferably of a molded configuration, that is firmly attached to the nozzle 28 through the use of fasteners, including without limitation, screws or rivets extending through brackets situated on opposite sides of the agitator housing 12. This general configuration is known in the art, such as the cleaner described in U.S. Pat. No. 4,178,653 issued Dec. 18, 1979, owned by a common assignee, and fully incorporated by reference herein.

Figure 3:
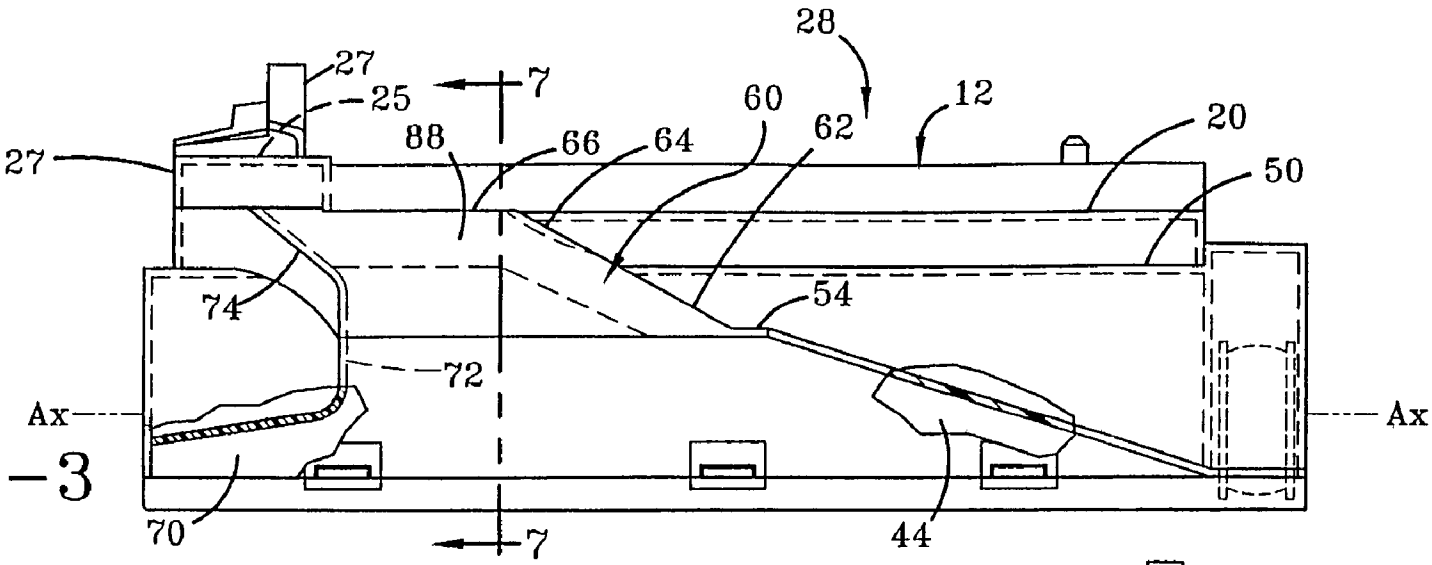
FIG. 3 is a front elevational view of FIG. 2.
Figure 4:
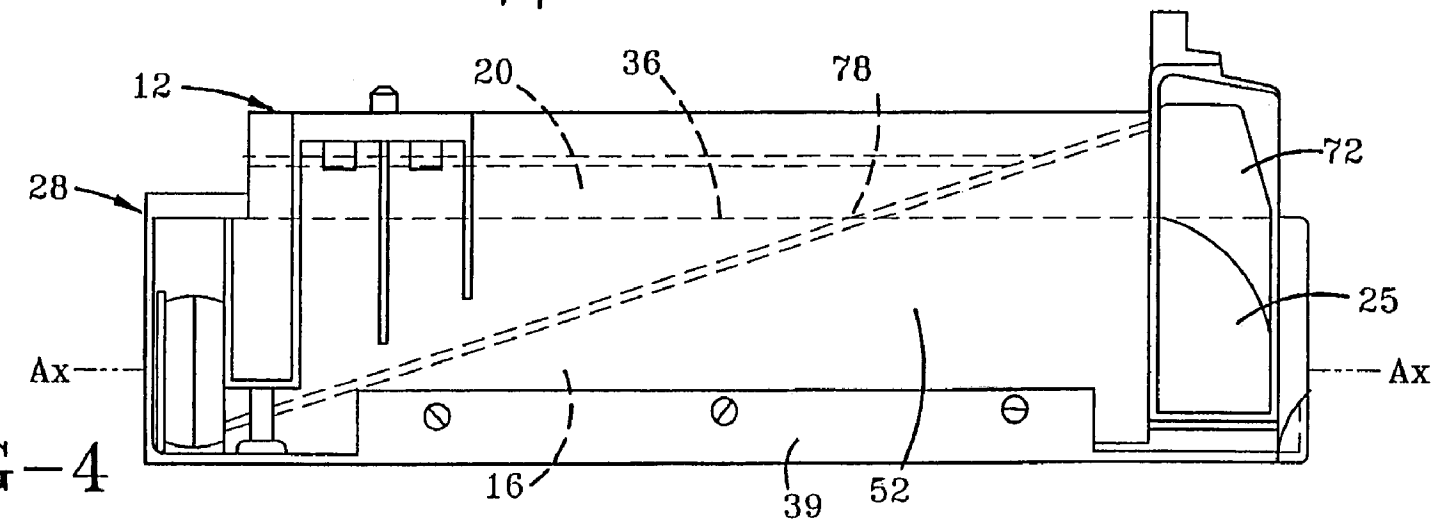
FIG. 4 is a rear elevational view of FIG. 2.
Figure 5:
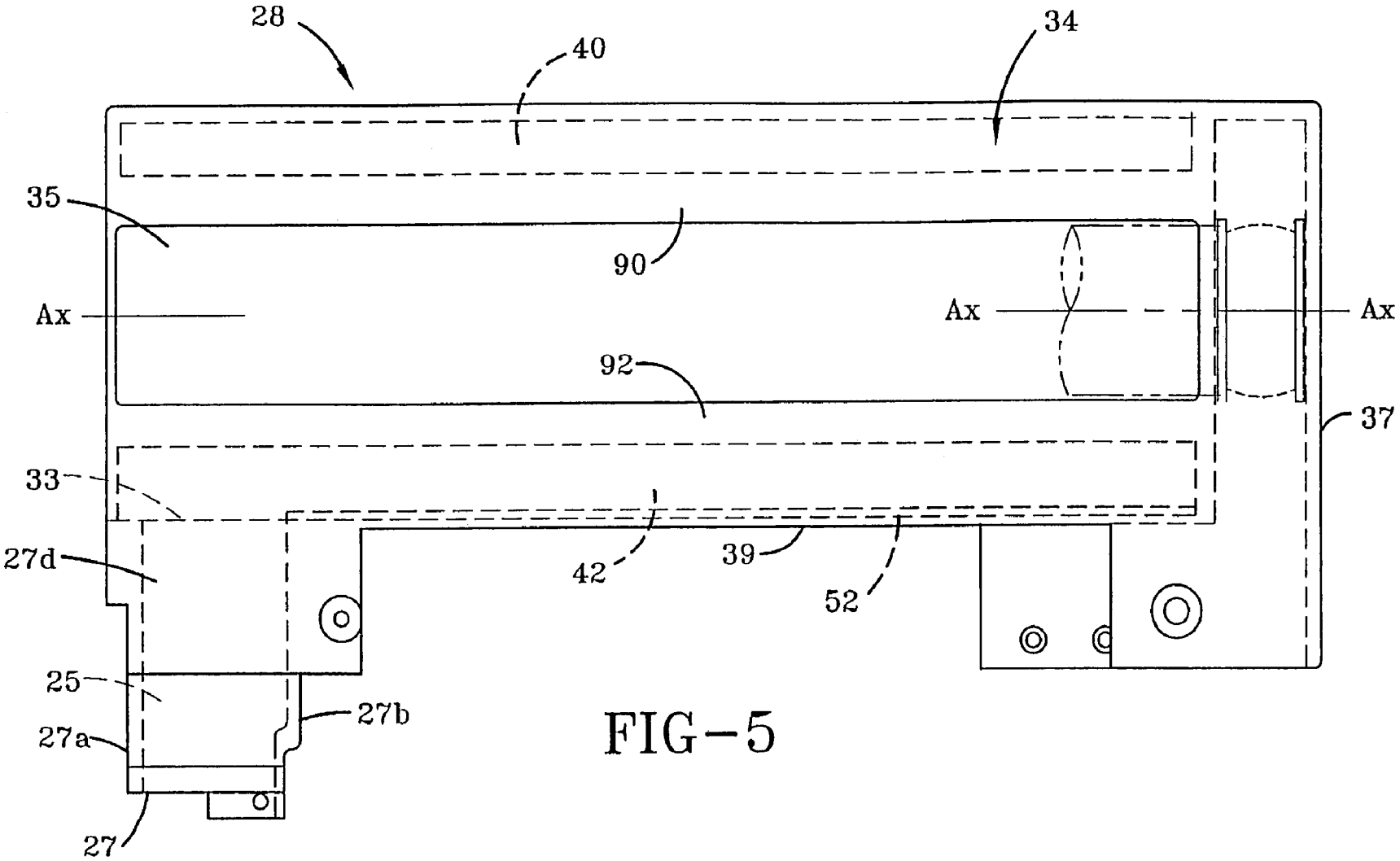
FIG. 5 is a bottom view of FIG. 2.

Referring now to FIGS. 2–5, suction nozzle 28 has the agitator housing 12, which includes a connected rearwardly extending side discharge duct 27. The rearwardly extending side discharge duct 27 defines a suction passageway 25 and leads conventionally to a motor-fan system (not shown) and the pair of integral front and rear sidewardly extending ducts, 40, 42 respectively and the rotatable agitator 14 disposed within the agitator housing 12. Turning to FIG. 5, the bottom plate 34 covers the bottom side of the agitator housing 12 and includes a suction slot 35 on which the agitator 14 is centered so as to be in surface engaging contact with the surface on which the nozzle 28 rests. The general configuration to be explained is disclosed in U.S. Pat. No. 5,513,418, issued May 7, 1996, owned by common assignee, and incorporated by reference fully herein.

Figure 2:
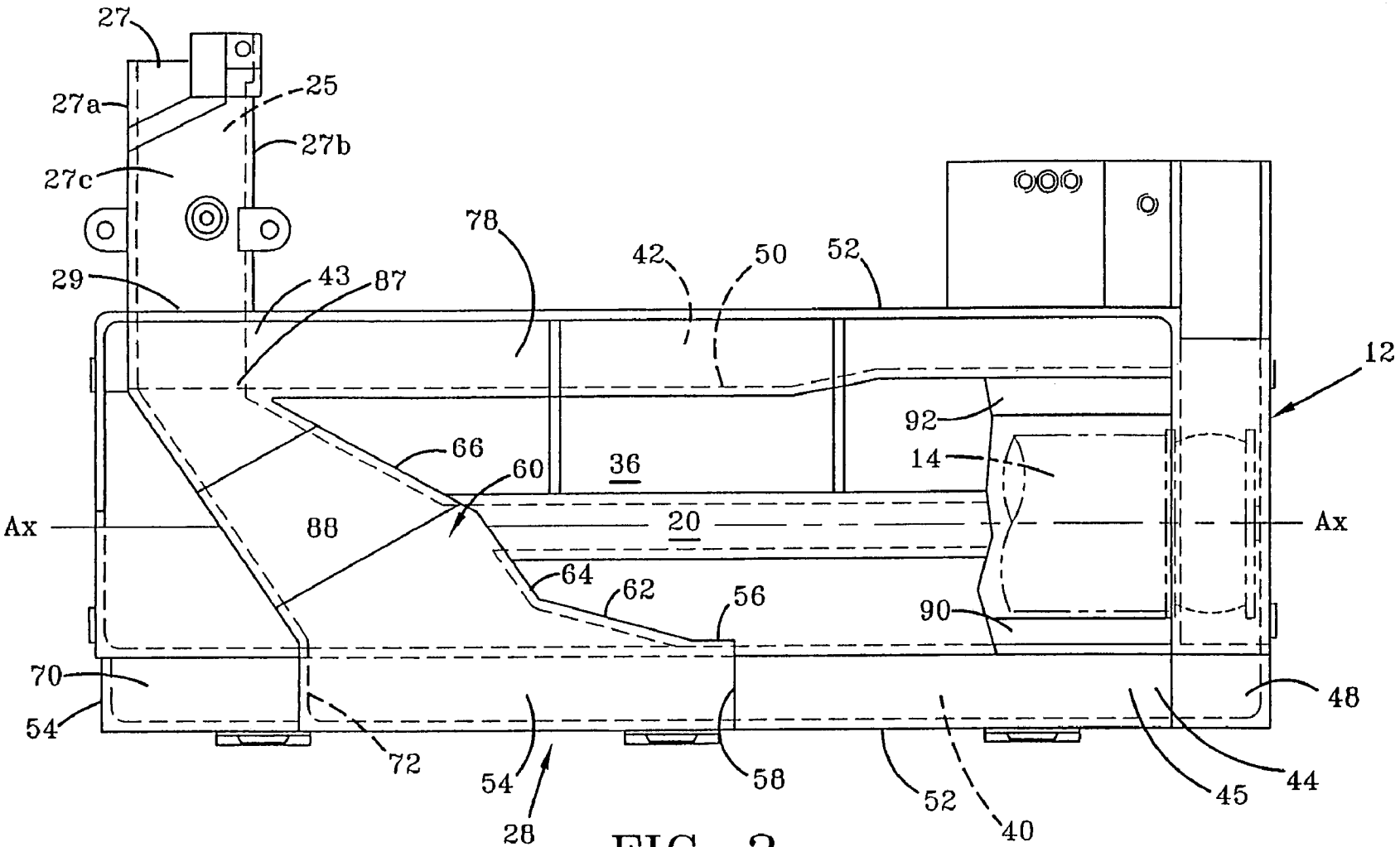
FIG. 2 is a top view of the suction nozzle arrangement shown in FIG. 1.

Referring now specifically to FIG. 2, and in addition. FIGS. 3 and 4, the rearwardly extending side discharge duct 27 extends juttingly rearwardly out of the agitator chamber 13 to provide communication with the conventional motor fan system (not shown) disposed downstream of the nozzle 28. The rearwardly extending side discharge 27 is formed with vertical walls 27*a*, 27*b* and a top and bottom horizontal walls 27*c*, 27*d* and provides vertically elongated rectangular shape to the suction passageway 25. This passageway 25, opens at its front, confluently at opening 33, best seen in FIG. 5, to front and rear sidewardly extending ducts 40, 42.

Of course, the rearwardly extending side discharge duct 27 may be of any other shape which is suitable for easy air passage.

FIG. 2 illustrates the front sidewardly extending duct 40 being shaped to provide as closely as possible a constant air carrying velocity along its length. The front sidewardly extending duct 40 continuously and uniformly expands along its length until it reaches the rearwardly extending side discharge duct 27. The front sidewardly extending duct 40 further comprises an integral upwardly angled duct section 44 including a top wall 45 extending from adjacent an end 48 of the agitator housing 12 oppositely disposed of the agitator housing 12 oppositely disposed of the rearwardly extending side discharge duct 27. The top wall 45 is angled uniformly upwardly from this end to approximately midway of the agitator housing 12. The top wall 45 length is integrally formed to a vertical wall portion 47 (FIG. 7) of the inner cylindrical section or surface 36 partially forming agitator chamber 13 wherein the first agitator 14 is disposed. Since the top wall 45 is angularly disposed until its inward termination, the vertical wall portion 47 (FIG. 7) is triangularly shaped in plan. The angled duct section 44 further comprises a front wall 46 (FIG. 7) parallel to the vertical wall portion 47 and similarly shaped which provides a completion of the angled duct section 44 except for its relationship with the bottom plate 34 and the front sidewardly extending duct 40 which will be described below.

Still viewing FIG. 2–4, air moving through the angled duct section 44 of the front sidewardly extending duct 40 enters a transition section 54 of the duct that passes over a bottom face wall formed by the top of the inner cylinder surface 36 of the agitator housing 13 to confluently communicate with the rearwardly extending side discharge duct 27. The transition section 54 adjacent to the inward termination of the duct section 44 includes a short adjoining portion 56 that communicates directly with the terminating end of the duct section and is the same height as this termination. It provides no expanding duct portion for maintaining constant air velocity but is necessary for easy moldability in the front duct and the agitator housing 12. Ideally, it is shortened and abbreviated so it does not seriously effect the constant carrying velocity of suction air passing through the front duct.

The short adjoining portion 56 merges into an expanding duct portion 60 which includes a forward lead in the wall 62. This lead in the wall is slightly angled relative to adjoining portion 56 upwardly over the inner cylindrical surface 36 to provide a smoothed airflow with the front duct 40. It merges with a more steeply angled wall 64 which is deeper and provides a transition into an angled wall piece 66. The angled wall piece 66 terminates, slightly spaced from the front suction opening of the rearwardly extending side discharge duct 27.

An opposite end 49 of the front duct 40 is formed with a short angled duct portion 70 like the duct portion 44 that angles upwardly along the agitator housing 12 towards the expanding duct portion 60. This short angled duct 70, again because of its expanding characteristics, provides a constant transport velocity characteristic to the suction air moving through it. It terminates in a vertically extending wall 72 extending upwardly from it along the inner cylindrical surface 36 and forming a portion of the other wall of the expanding duct portion 60. This wall merges into an angularly extending also extending along the inner generally cylindrical surface 36 until it terminates adjacent opening 87 in the wall portion.

Still viewing FIGS. 2–5, the rear sidewardly extending duct 42 extends along a rear side of the agitator housing 12 in an expanding way. It includes an upwardly angled top wall 78 generally integral upwardly angled forward wall 50. A portion of the upwardly angled forward wall 50 is formed by the external surface of the inner cylindrical surface 36 and a portion on the vertical extension and a rear vertically extending reinforcing wall 52. This wall is integrally formed with the upwardly angled top wall 78 and extends there above to be generally aligned with the top side of the rearwardly extending side discharge duct 27. It forms the rear side of the agitator housing 12 at its bottom. The rear duct 42 terminates in a discharge opening which is as deep in height as the actual rearwardly extending side discharge duct 27 at its suction opening to confluently connect thereto. A suction opening of the front sidewardly extending duct 40 is also in confluent communication with these two openings and is essentially located flush with the forward wall 50 of the rear duct 42.

For molding requirement ease, the expanding duct portion is formed without a top wall so that a top wall of the exact top outline and vertical terminating shape of the expanding duct portion is mounted there on by gluing the like to complete the closed volume of the front sidewardly extending duct 40.

Figure 7:
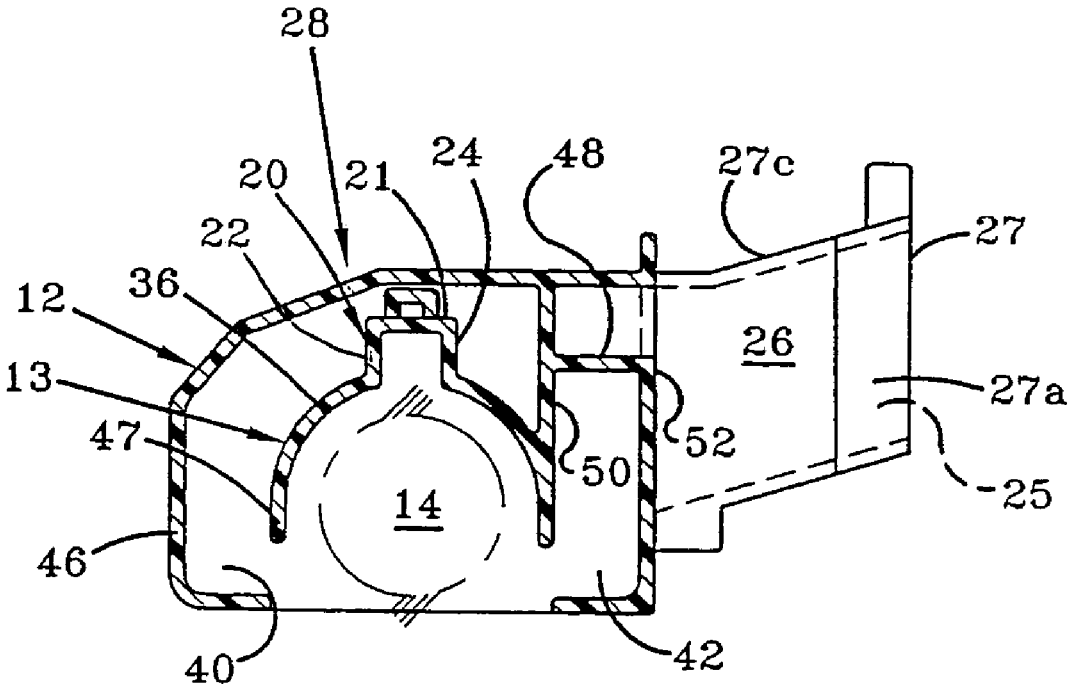
FIG. 7 is a cross-sectional view of the preferred embodiment of the suction Nozzle arrangement of FIGS. 1–5 taken along line VII—VII of FIG. 3, wherein the suction nozzle arrangement similar to the suction nozzle arrangement shown in FIG. 6 but with a single channel and a pair of sidewardly extending front and rear ducts.
Figure 8:
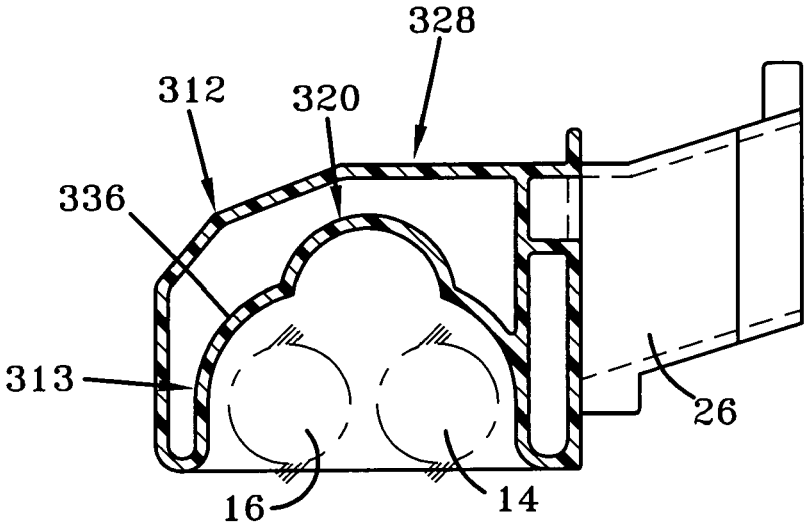
FIG. 8 is a cross-sectional view of a third embodiment of suction nozzle arrangement having a hemispherical single channel located central above dual rotary agitators.

A cross-section of the suction nozzle 28 of the preferred embodiment is shown in FIG. 7. The agitator housing 12 includes the inner generally cylindrical surface or section 36 as is conventional in the cleaner art. This section or surface 36 begins generally at the front of the agitator housing 12 and extends upwardly and circumferentially inwardly until interrupted by the first channel 20. First channel 20 comprises a top wall 21 and may further comprise first and second side walls 22, 24, 6, 7, and 10 or hemispherical in shape as shown in FIG. 8 to eliminate any sharp corners. The top wall 21 may have a substantially uniform depth, or its depth may increase as the first channel 20 approaches the suction connection 26.

As previously mentioned, the inner cylindrical section or surface 36 is interrupted by the first side wall 22 and then continues from the second side wall 24 in a circumferentially outwardly direction. The first channel 20 extends across the nozzle 28. As shown in FIG. 7, the first channel 20 is located at a top center position of an agitator housing 12. However, the first channel 20 may be located in other positions along the inner cylindrical section or surface 36. The position of first channel 20 as shown in FIGS. 6–8 and 10 is preferred and provides for constant air The inner cylindrical section or surface 36 terminates in the rear section of the agitator housing 12. The first agitator 14 tends to move air along the first channel 20 in the agitator housing 12 towards a tubular formed suction connection 26, which is also integral with the agitator housing 12. The suction connection 26 in turn communicates rearwardly with a rigid nozzle suction duct extending to the motor fan system (not shown) for the nozzle 28. The manner of sealing the suction connection with the nozzle suction duct may be any conventional arrangement desired.

Suction applied to the suction connection 26 provides a flow of suction air through the agitator housing 12. Because of the position and shape of the first channel 20, the velocity and pressure across the face of the nozzle 28 tends to be relatively constant.

Figure 6:
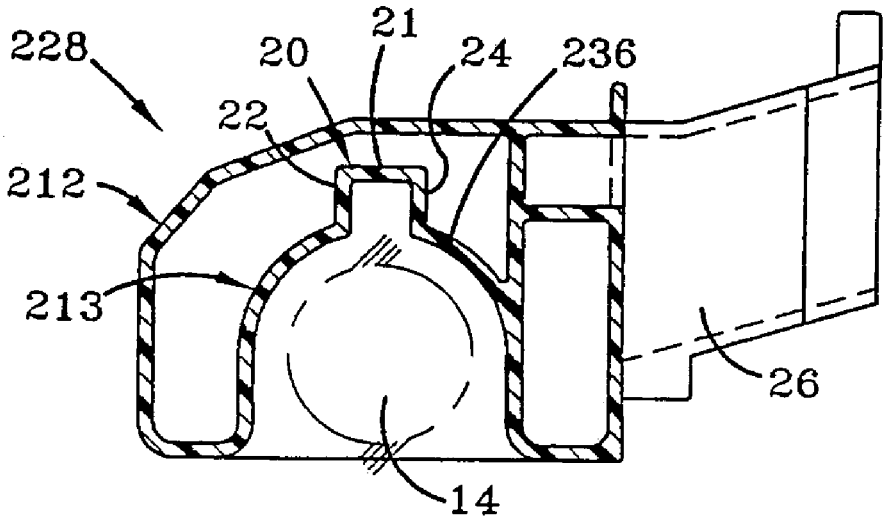
FIG. 6 is a cross-sectional view of an alternate embodiment of a suction nozzle arrangement having a single channel located centrally above the agitator.

In an alternate embodiment of the invention, shown in FIG. 6, the vacuum cleaner 10 comprises the first channel 20 and a single agitator 14 in a suction nozzle arrangement 228 similar to the preferred embodiment. A similar inner generally cylindrical surface or section 236 is interrupted by channel 20. However, there are not front and rear suction ducts 40, 42 and a section or surface 236 forming agitator chamber 213 is continuous and meets with front and rear sidewalls on the interior of agitator housing 212.

In a third embodiment of the present invention, shown in FIG. 8, the vacuum cleaner 10 comprises a suction nozzle arrangement 328 having a first channel 320 and two agitators 14, 16. The agitator housing 312 and agitator chamber 313 must be of sufficient dimension to accommodate the agitators 14, 16 in a side-by-side relationship and yet permit air to readily flow through the first channel 320. The dual agitators 14, 16 should be in close proximity to maximize dirt removal from the underlying surface. This is true for all embodiments later described utilizing a dual aviator system. Of course it should be noted that the first and second agitators 14, 16 can roll in the same direction, clockwise or counterclockwise depending on the agitator drive means utilized.

Figure 10:
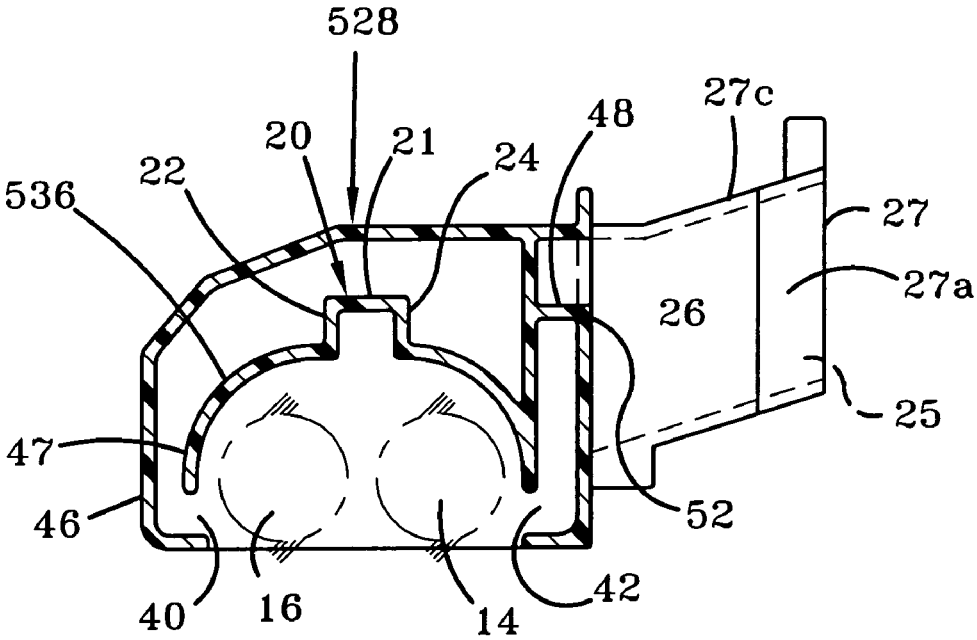
FIG. 10 is a cross-sectional view of a fifth embodiment of a suction nozzle arrangement having sidewardly extending front and rear ducts, dual agitators, and a channel located centrally located above the agitators.

Alternately, the agitators 14,16 can counter-rotate towards each other or away from each other. The first channel 320 may be positioned above and between the first and second agitators 14, 16 as shown in FIGS. 8 and 10. The first channel 320 has a semi-hemispherical cross-section and is formed in the inner generally cylindrical surface or section 336 and is disposed centered above agitators 14, 16. Since no suction ducts 40, 42 are present, inner generally cylindrical surface 336 extends continuously from the interior front and rear sidewalls of agitator housing 312 except for where interrupted by first channel 320.

Figure 9:
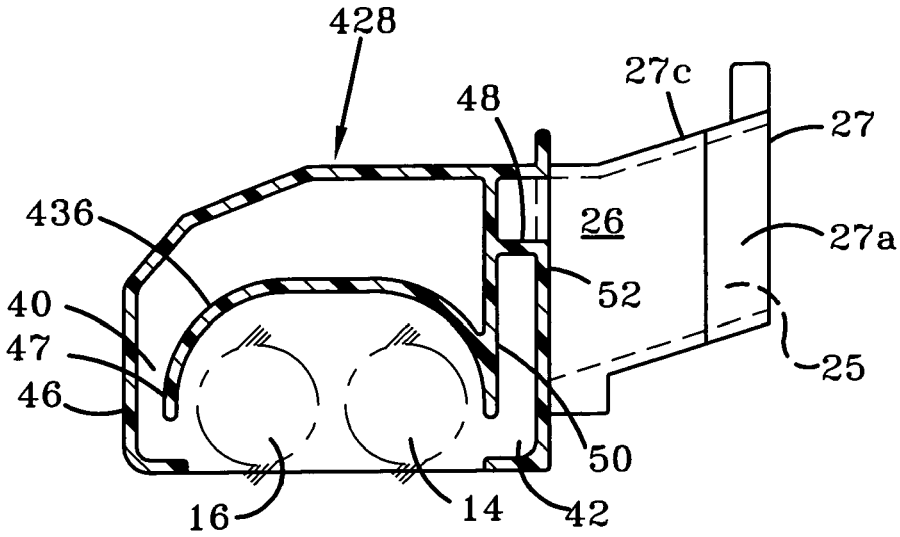
FIG. 9 is a cross-sectional view of a fourth embodiment of a suction nozzle arrangement having sidewardly extending front and rear ducts and dual agitators.

In a fourth embodiment of the invention, vacuum cleaner 10 comprises a suction nozzle arrangement 428 having at least two agitators 14, 16 as shown in FIG. 9. Further, only the front and rear channels 40, 42 are present. As previously mentioned, these agitators 14, 16 may rotate in the same direction, clockwise or counterclockwise. Alternately, the agitators 14, 16 could counter-rotate, meaning towards each other or away from each other. The fourth embodiment of the invention eliminates the first channel 20 of the preferred embodiment taking advantage of the improved cleaning efficiency of front and rear channels 40, 42 as well as the improved cleaning performance of a second agitator 16. The internal generally cylindrical surface 436 is continuous from front suction duct 40 to rear suction duct 42.

In a fifth embodiment of the present invention, as shown in FIG. 10, a suction nozzle arrangement 528 incorporates channel 20 and front and rear suction ducts 40, 42 as described previously in the preferred and fourth embodiments, and dual agitators 14, 16. As described in great detail previously, the first channel 20, which is located disposed centrally above the two agitators 14, 16 and formed in an inner generally cylindrical section or surface 536, provides for greater air flow, more constant air flow, and increased dirt removal from the underlying surface.

There are infinite possibilities for providing rotary power to a single agitator 14 or a combination of at least two agitators 14, 16. Several embodiments of the invention are presented herein for providing rotary power to a first agitator 14, or alternately to a first agitator 14 and a second agitator 16. Any one of the below other aspects of the invention for providing rotary power to the agitator(s) could be used with any of the foregoing embodiments of the suction nozzle arrangements 28, 228, 328, 428 and 528.

Figure 11:
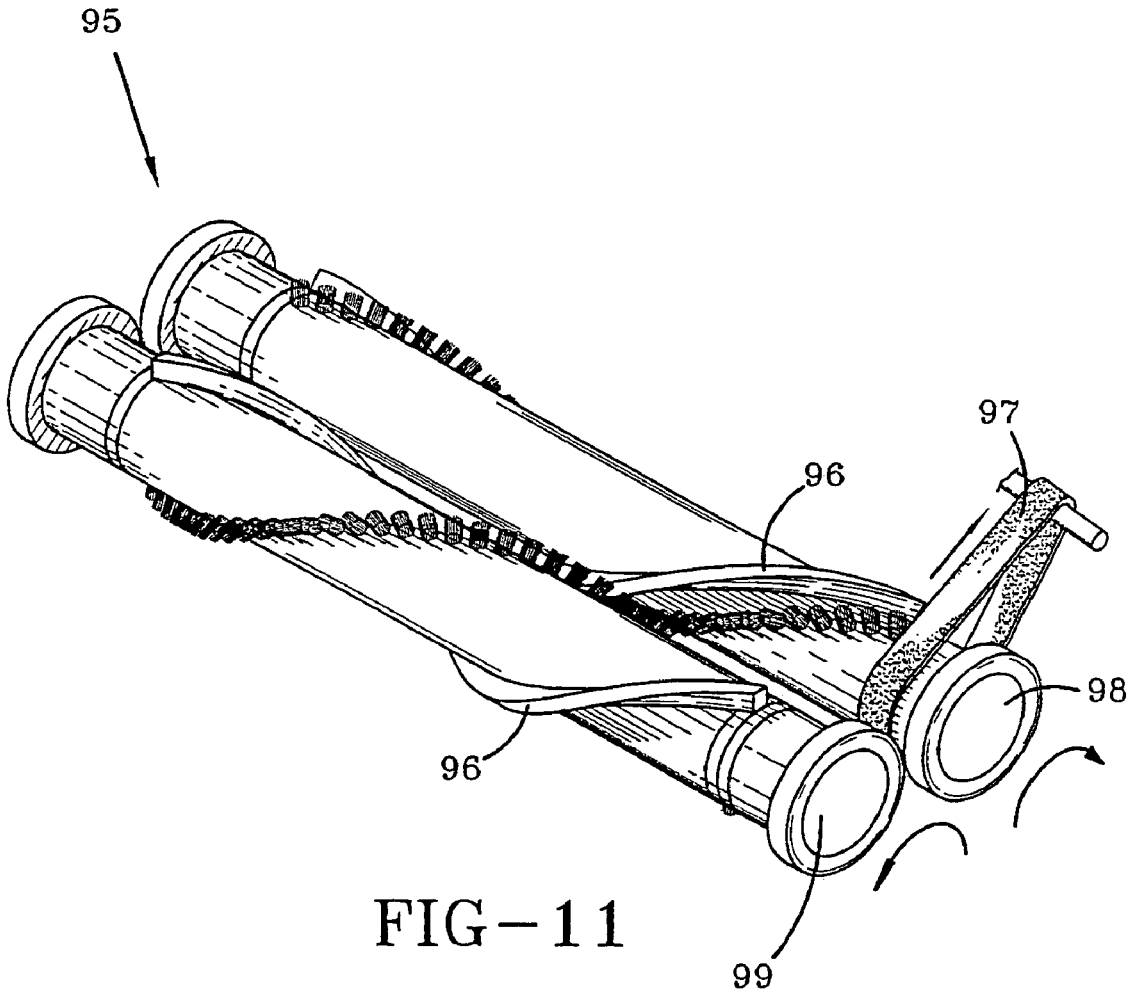
FIG. 11 shows a counter-rotating interlaced helix agitator assembly having a single flat belt for driving a first agitator, wherein the first agitator has a helical ribbon circumscribing the outer surface for meshing with a helical ribbon circumscribing the outer surface of a second agitator thereby driving the second agitator.

In one embodiment of the present invention, as shown in FIG. 11, a counter-rotating interlaced helix agitator assembly 95 is depicted wherein a second agitator 99 is driven by first agitator 98. The first agitator 98 is rotated by a flat belt 97, and a first projection or first helical ribbon 96 circumscribing the outer surface of first agitator 98 meshes with a corresponding second projection or second helical ribbon 96 circumscribing the outer surface of a second agitator 99. First and second helical ribbon 96 may be made of plastic material and is formed in a spiral circumscribing and radially extending front the outer surface of agitators 98, 99. While the first and second agitators 98, 99 are counter-rotating, a continuous point of contact is maintained along the first and second helical ribbons 96 of the two agitators 98, 99 during rotation.

Figure 12:
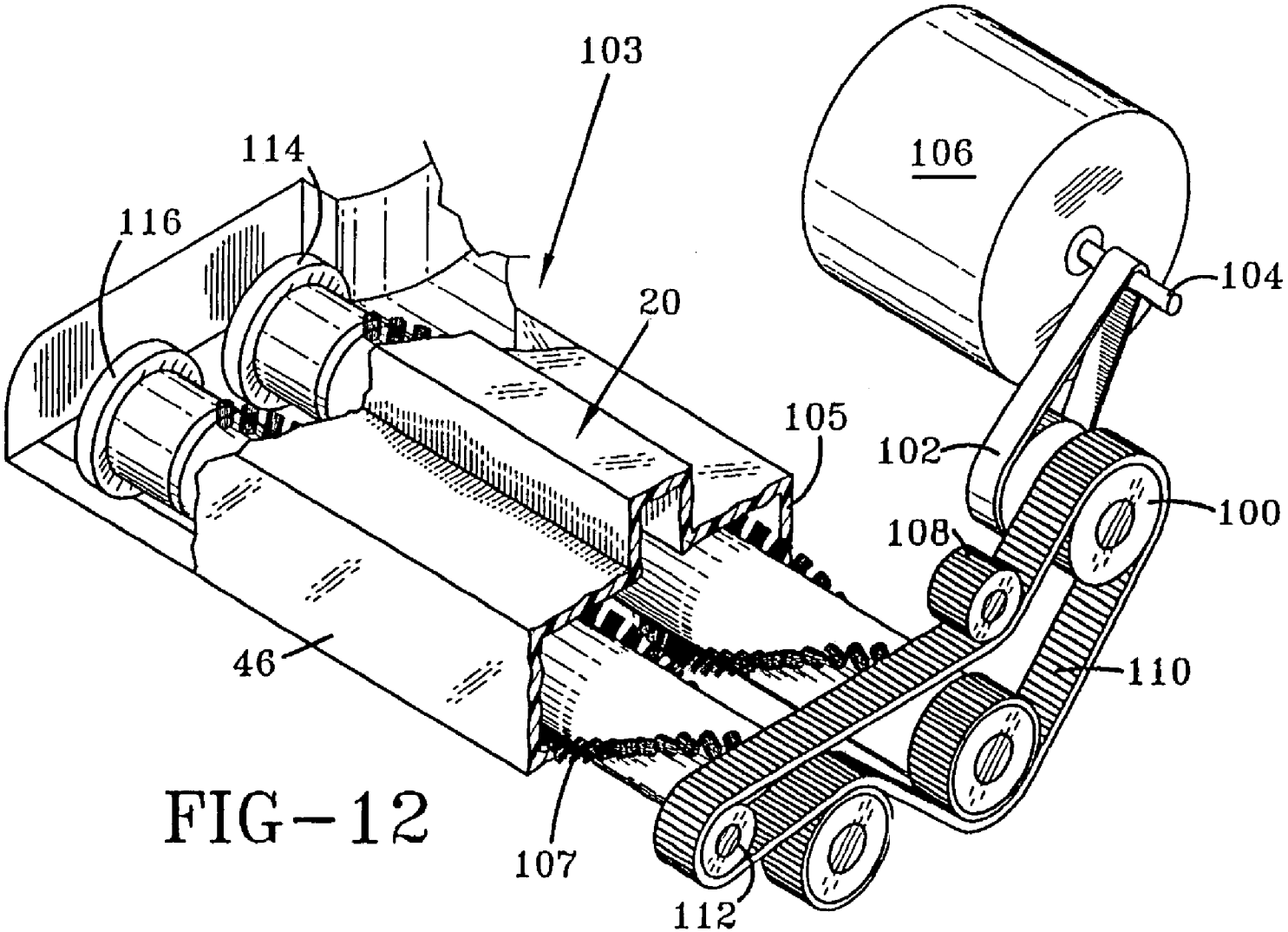
FIG. 12 shows another agitator assembly wherein a flat belt drives a pulley, the pulley drives a toothed belt, and the toothed belt drives a pair of rotary agitators.

In another embodiment of the present invention, as shown in FIG. 12, and described in further detail in U.S. Pat. No. 6,131,238, issued Oct. 17, 2000, and owned by a common assignee, an agitator assembly 103 is provided comprised of a pulley 100 driven by a toothed belt 102, communicating with the drive shaft 104 of the motor 106. The toothed belt 110 is positioned about the pulley 100, the first agitator 114 and at least one idler gear 108. The toothed belt 110 contacts at least some portion of a second idler gear 112 and the second agitator 116. Thus, when the pulley 100 is rotated by the motor 106, the first and second agitators 114, 116 are engaged by the toothed belt 110 and counter-rotate.

Figure 13:
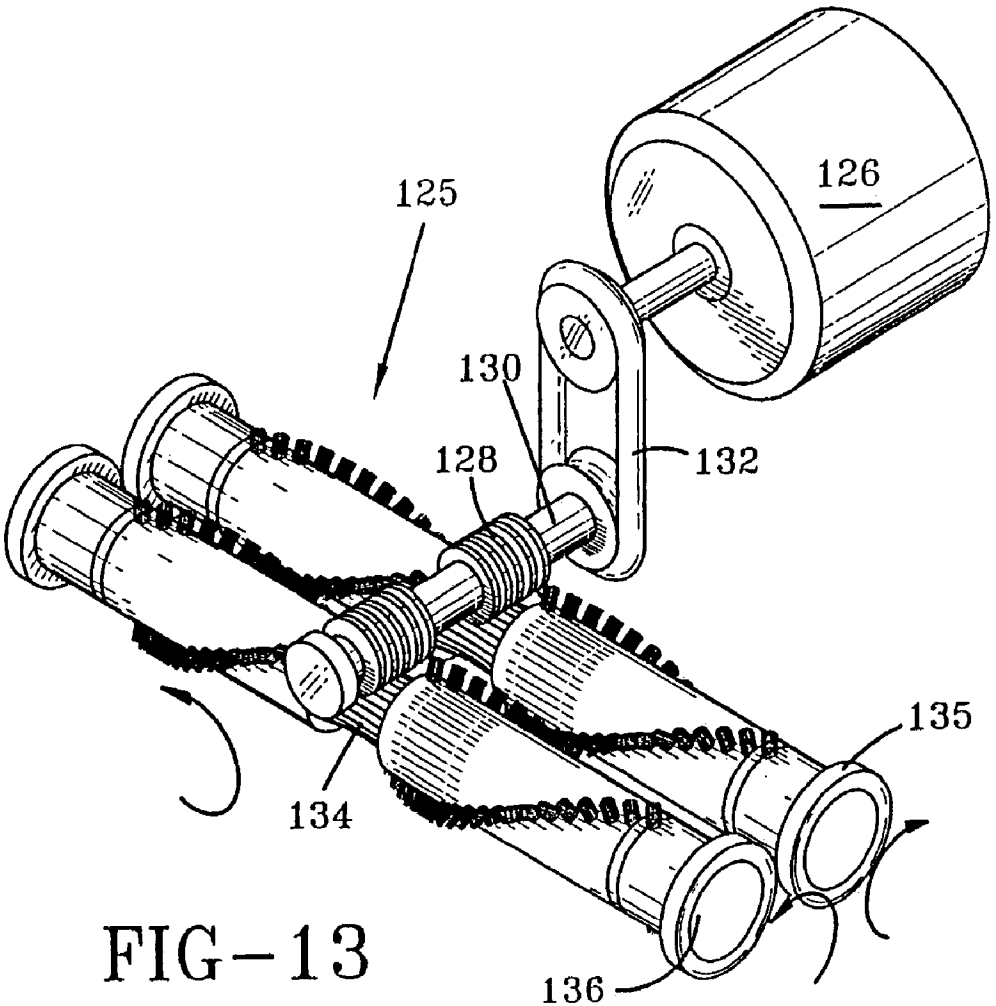
FIG. 13 shows yet another agitator assembly wherein a pair of rotary agitators are rotated by a belt and worm gear.

FIG. 13 illustrates yet another embodiment of the invention wherein another agitator assembly 125 is provided wherein a motor 126 drives a worm gear 128, which in turn drives the two agitator or agitator bars 135, 136. This embodiment is similar to that disclosed in U.S. Pat. No. 1,900,889, issued Mar. 7, 1933, and owned by a common assignee. Driving or rotating means is provided for the agitator or agitator bars 135, 136. The driving means comprises a shaft 130, which is rotated by a belt 132 and is perpendicular to the agitator or agitator bars 135, 136. The shaft 130 is provided with spaced worm gears 128 having opposite directions of thread advance and these gears mesh with spiral gears 134 carried by the respective stub shafts of the agitator or agitator bars 135, 136. It should be noted that many variations are possible with this embodiment of providing the required rotary power to agitator or agitator bars 135, 136. First, the worm gear assembly can be located at the center of a nozzle arrangement to drive two agitator or agitator bars 135, 136, as shown in FIG. 13, or it may be located on the ends of the agitator or agitator bars 135, 136. If the worm gear assembly is located at the center of the suction nozzle arrangement like any of the suction nozzles in the aforementioned embodiments, four small agitators may be utilized. Further, the worm gear may mesh with only one agitator, which in turn could drive the second agitator. It is also contemplated that the worm gear can rotate both agitator bars 135,136 and the agitators be so positioned to interlace during rotation.

The present invention has been described above using a preferred embodiment, alternate embodiments, and other aspects by way of example only. Obvious modifications within the scope of the present invention will become apparent to one of ordinary skill upon reading the above description and viewing the appended drawings. The present invention described above and as claimed in the appended claims is intended to include all such obvious modifications within the scope of the present invention.

What is claimed is:

1. An agitator assembly for a floor care appliance, comprised of:

a first agitator;

a second agitator;

a first projection located on and radially extending from an outer surface of said first agitator;

a second projection located on and radially extending from an outer surface of said second agitator; and wherein said second agitator is driven by said first projection meshing with said second projection.

2. The agitator assembly of claim 1 wherein said first agitator is rotatably driven by an independent drive motor.

3. The agitator assembly of claim 1 wherein said first agitator is rotatably driven by a belt.

4. An agitator assembly for a floor care appliance, comprised of:

a first agitator;

a second agitator;

a first projection radially extending from an outer surface of said first agitator;

a second projection radially extending from an outer surface of said second agitator; and wherein said second agitator is driven by said first projection meshing with said second projection; and wherein said first projection is a helical ribbon circumscribing the outer surface of said first agitator and said second projection is a helical ribbon circumscribing said outer surface of said second agitator and a continuous point of a contact is maintained along the helical ribbons circumscribing said first and second agitators during rotation.

5. The agitator assembly of claim 4 wherein said first agitator is rotatably driven by an independent drive motor.

6. The agitator assembly of claim 4 wherein said first agitator is rotatably driven by a belt.

* * * * *